US005540392A

United States Patent [19]

Broderick et al.

[11] Patent Number: 5,540,392

[45] Date of Patent: Jul. 30, 1996

[54] OPTIMAL ENERGY REFINING PROCESS FOR THE MECHANICAL TREATMENT OF WOOD FIBRES

[75] Inventors: Gordon Broderick, St. Lazare; Robert Lanquette; Jacques Valade, both of Trois-Rivières Quest, all of Canada

[73] Assignee: Noranda, Inc., Toronto, Canada

[21] Appl. No.: 454,687

[22] Filed: May 31, 1995

[51] Int. Cl.[6] ..... R02C 7/02

[52] U.S. Cl. ..... 241/28; 241/29

[58] Field of Search ..... 241/21, 28, 29

[56] References Cited

U.S. PATENT DOCUMENTS

| | | | |
|---|---|---|---|
| 4,116,758 | 9/1978 | Ford et al. | 162/28 |
| 4,211,605 | 7/1980 | Saxton et al. | 162/64 |
| 5,089,089 | 2/1992 | Beaulieu | 162/234 |
| 5,167,373 | 12/1992 | Bohn et al. | 241/28 |
| 5,248,099 | 9/1993 | Lahner et al. | 241/28 |
| 5,335,865 | 8/1994 | Kohler et al. | 241/28 |

FOREIGN PATENT DOCUMENTS 2094674 12/1993 Canada .

OTHER PUBLICATIONS

Danforth, *Effect of Refining Parameters on Paper Properties*, Pira International Conference New Technologies in Refining, Bimingham, England, 1986, Paper 11, 12 pages.

Miles et al, *J. Pulp & Paper Science*, 1990, 16(2), J63–J71.

Miles, *Paperi jaa Puu*, 1991, 73(9), 852–857.

Miles et al., *Tappi Journal*, 1991 , 74(3),221–230.

Stationwala et al., *J. Pulp & Paper Science*, 1993, 9(1), J12–J18.

*Primary Examiner*—John Husar

*Attorney, Agent, or Firm*—Fitzpatrick, Cella, Harper & Scinto

[57] ABSTRACT

The present invention is concerned with an improvement in the mechanical treatment of wood fibers, the improvement consisting in applying a large amount of energy at low intensity in the first stage of refining of the wood chips, and a small amount of energy at high intensity in the second stage. The present improvement allows a reduction in energy consumption as high as 18%.

11 Claims, 9 Drawing Sheets

OPTIMAL ENERGY REFINING PROCESS FOR THE MECHANICAL TREATMENT OF WOOD FIBRES

FIELD OF THE INVENTION

The present invention is concerned with a process for optimizing the energy during the mechanical treatment of wood fibres in refiners.

BACKGROUND OF THE INVENTION

Although mechanical treatment of wood fibres with refiners has been a commercial reality since 1960, the mechanisms involved in refiner pulping are still not thoroughly understood. Refining is a critical step in the pulping process and refining energy for this pulp will typically account for close to a third of the total energy costs associated with newsprint production. As a result, the incentive for optimizing the energy efficiency and pulp quality produced by this part of the process is quite significant.

Developments in the field of refining theory during the early 1980's suggested that fibre development in the refiner is governed not only by the total amount of energy used, but also by the manner in which this energy is applied. In *PIRA Int. Conf. New Technologies in Refining (Birmingham, England)*, 1986, Proc. (vol. 2), Session 4, Paper 11, Danforth introduced the concept of impact intensity, showing that the number of impacts received by the fibres during refining is an important factor in the development of pulp quality. The theory took into account the effects of consistency or solid content, rotational speed, as well as the effect of refiner geometry or design. Recent study of high consistency chip refining by Miles et at. in *Journal of Pulp and Paper Science,* 1990, 16(2), J63-J71; and *Paperi ja Puu,* 1991, 73(9), 852–857, has produced a set of equations describing the consistency and pulp velocity profiles in the refiner. These equations make it possible to calculate the residence time of the pulp in the refiner and hence the number of bar impacts delivered to the fibres. Calculated specific energy per bar impact, or refining intensity, has been shown to correlate well with pulp handsheet properties.

Optimizing refining conditions consists therefore in finding the appropriate combination of these two factors, namely specific energy and refining intensity. This problem is further complicated in a two-stage system where the operating conditions required to optimize pulp quality or energy efficiency in the second stage of refining will depend on the treatment applied to the fibres in the primary stage. Few studies have examined the interactions between refining stages over a significant range of conditions, and fewer still have attempted to quantify these effects.

Researchers at the Pulp and Paper Research Institute of Canada (PAPRICAN) have since developed a refining strategy based on pilot-scale pulping trials conducted over a specific range of conditions (see *Tappi Journal,* 1991, 74(3), 221–230; and *Journal of Pulp and Paper Science,* 1993, 19(1), J12-J18). The PAPRICAN strategy consists of applying the bulk of the specific energy used in two-stage refining at high intensity in the first stage of treatment. Subsequent commercial scale trials conducted at the Kruger Company's Bromptonville facility lead to three papers published in the patent literature assigned to Andritz Sprout-Bauer, namely U.S. Pat. No. 5,167,373, CA 2,094,674, and U.S. Pat. No. 5,248,099.

Andritz Sprout-Bauer (at one time called ABB Sprout-Bauer) has essentially patented the PAPRICAN two-stage refining strategy by designing and patenting machinery which physically embodies such treatment.

Although the good results obtained by PAPRICAN and Sprout-Bauer have provided evidence for the optimization of the energy efficiency and pulp quality produced by refining, there is still a great need to further improve this process.

SUMMARY OF THE INVENTION

In accordance with the present invention, there is now provided an improvement to current methods for the mechanical treatment of wood fibres, the method comprising the steps of reducing wood chips to individual fibres or fibre bundles by mechanical treatment applied in two stages of atmospheric or pressurized refining using two single-disc refiners or one double-disc refiner. More specifically, the improvement comprises applying at least 65% of the total energy at low intensity in the first stage of refining and the remainder at high intensity in the second stage. Such distribution allows reduction in the energy requirements of up to 18%. The maximum applicable energy in the first stage is around 85%, depending on the other parameters.

IN THE DRAWINGS

FIG. 1 illustrates how changes in plate gap and consistency in the first stage of pilot-scale refining affect the specific energy consumed and the freeness of the pulp obtained;

FIGS. 2(*a*), (*b*) illustrates how pulp handsheet tear strength and refiner energy consumption are affected by changes in the plate gap and consistency used in the primary stage (a) and in the secondary stage (b) of pilot-scale refining;

Figure 8:
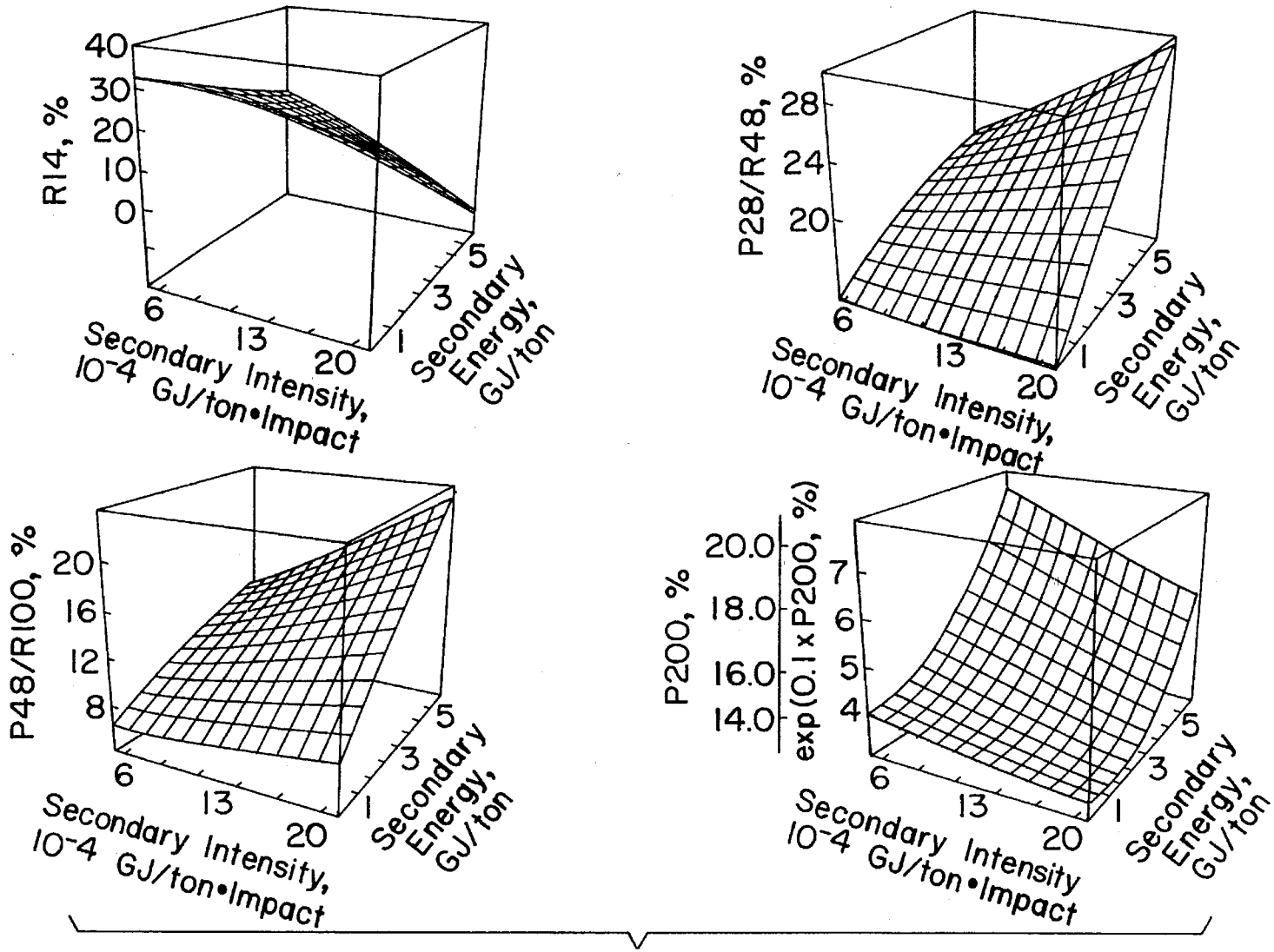
Figure 9:
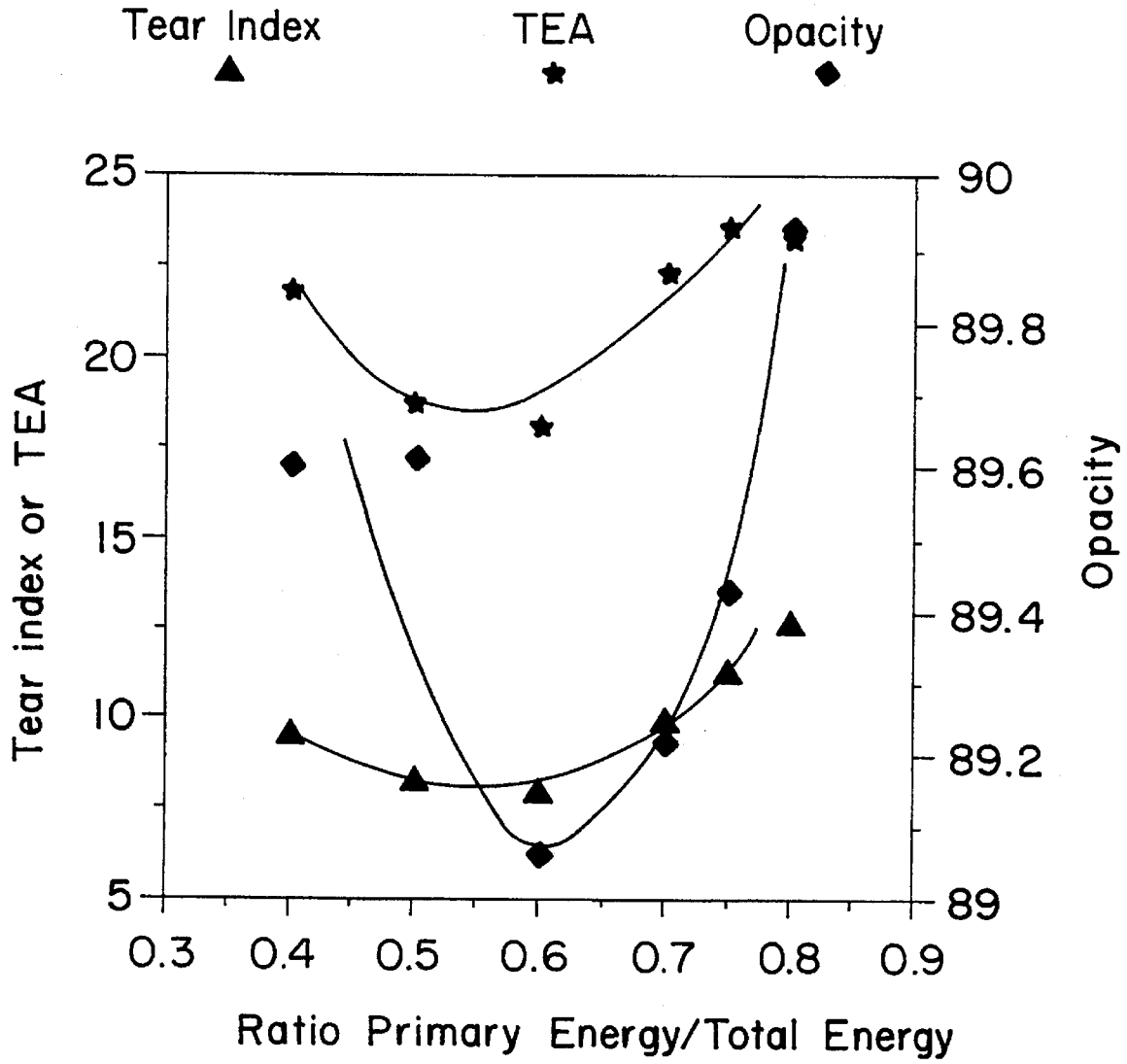

FIG. 8 illustrates the response of various Bauer-McNett fibre length fractions in the final pulp to changes in secondary specific energy and refining intensity (with primary refining conducted at 2.8 GJ/t and $8.6\times10^{-4}$ GJ/t·impact); and FIG. 9 illustrates optimal values of pulp tear index, tensile energy (TEA) and opacity which are attainable using different energy distributions between stages for a total specific energy level of 1800 kWh/t.

DETAILED DESCRIPTION OF THE INVENTION

The present invention provides an improvement to conventional two-stage refining method for high-yield pulps (> 80% yield), the method being adapted to be used with standard equipment such as for example two sequential stages equipped with Andritz Sprout-Bauer single-disc refiners of the type 45-1B, in such way as to reduce energy consumption by as much as 18% while maintaining pulp quality at higher freeness. Such improvement is accomplished by applying a high amount of energy, more specifically at least 65% of the total specific energy at low intensity in the primary stage, and the remaining energy at high intensity in the secondary stage. Examples of double-disc refiners include the model 488-4, which is manufactured and sold by Andritz Sprout-Bauer. Examples of single disc refiners include model 45-1B, manufactured and sold by Andritz Sprout-Bauer. These devices are well known to anyone of ordinary skill in the art. The finding that the energy consumption is reduced by as much as 18% when a large amount of energy at low intensity is used in the first stage, combined with a small amount energy at high intensity in the second stage, is totally unexpected since these treatment conditions are exactly the opposite of what is taught in U.S. Pat. No. 5,167,373, CA 2,094,674, and U.S. Pat. No. 5,248,099.

Typically, the refining of a high yield pulp comprises the following steps. Wood chips are pretreated either with steam alone or with a sulphite based solution to soften the lignin in the wood and prepare the chips for the subsequent mechanical treatment. This mechanical treatment breaks down the chips into individual fibres and fibre bundles and is generally conducted in two sequential stages using disc refiners operating at or above atmospheric pressure.

In a typical very high yield chemi-mechanical pulping method, chips are pretreated chemically using a 12 to 17% sodium sulphite ($Na_2SO_3$) charge, based on wood, with a preheating time ranging from 10 to 60 minutes and a cook time of approximately 80 minutes at temperatures between 130° and 160° C. Yields of pulp on wood superior to 80% are generally obtained. The softened chips are fed to the primary refiners at a consistency of approximately 26 to 40% solids where approximately 800 to 1000 kWh/t of energy is applied at atmospheric pressure. The resulting pulp is then conveyed and fed to the secondary refiners, where once again approximately 800 to 1000 kWh/t of energy is applied at inlet consistencies of 25 to 40% solids and atmospheric pressure to obtain a final pulp freeness in the range of 400 to 550 ml. After leaving the second stage of refining, the pulp is maintained at a temperature of approximately 60 ° C. for at least 20 minutes to allow for stress relaxation or the removal of latency from the fibres.

In comparison, producing a typical chemi-thermomechanical pulp involves treating the chips with a chemical charge of 2 to 6% sodium sulphite based on wood, preheated and stored at temperatures between 90° C. and 130° C. for 20 to 30 minutes. The softened chips are then refined in two sequential stages operated at pressures close to 25 psi where approximately 2500 kWh/t of specific energy is applied to produce a final freeness in the range of 100 to 250 ml. A typical thermomechanical pulping operation operates in a similar manner with the exception that steam alone is used to pretreat the chips. Both thermomechanical (TMP) and chemi-thermomechanical (CTMP) pulps are produced at yields of close to 95%.

A variety of other similar chemical treatments may be applied using different combinations of chemical concentration, pH, temperature and duration. The method used to soften the wood lignin is inconsequential to the effectiveness of the refining improvement disclosed and claimed in the present application, as is the use of pressurized or atmospheric refiners. The present refining improvement may therefore also be applied to pressurized two-stage refining in the production of typical CTMP and TMP pulps.

As mentioned above, the refining in the first stage is performed at low intensity, while in the second stage, it is performed at high intensity. "Intensity" is defined as the specific energy per bar impact on the fibres or fibre bundle. The intensity can be varied by increasing or reducing the speed of the disc of the refiner. However, the majority of conventional refiners are not provided with engines having variable speed. The alternative is to modify the consistency. For example, if the consistency is high, typically between 26–40% of solids, the intensity will be low. This is explained by the fact that the amount of water is reduced, thus giving a higher residence time of the wood chips in the refiner. The number of impacts is therefore higher, causing the energy to be distributed in a greater number of impacts. Conversely, if the consistency is low, typically between 15–26% of solids, the intensity will be high because the amount of water is greater, thus giving a shorter residence time of the wood chips in the refiner. The number of impacts is therefore smaller, causing the energy to be distributed in lesser impacts.

The following examples are provided to illustrate the present invention and should not be construed as limiting its scope.

PILOT PLANT TESTS

A series of 30 pilot scale pulping trials was conducted initially where freshly cut black spruce chips were treated with a sodium bisulphite liquor having an initial pH of 4.0, and a total $SO_2$ concentration of 3.5%, for a period of one hour at 140° C. resulting in a yield of approximately 90% and a chip sulphonate content of close to 1.4%. These sulphonated chips were subjected to two consecutive stages of atmospheric refining using a Sunds CD- 300 refiner with consistencies and plate gaps controlled independently to five distinct levels in accordance with a central composite (CCD) statistical design. Five replicate trials were performed at mid-range conditions to give the design uniform precision over the experimental region spanned and provide a means for assessing random experimental error. Plate gaps ranging between 0.2 and 0.6 mm were combined with inlet consistencies of 6 to 18% to apply specific energy levels between 1 and 7 GJ/t, at refining intensities of $3\times10^{-4}$ to $15'10^{-4}$ GJ/t per impact. The results of this pilot plant study are discussed in details below.

Consistencies closer to 30% were later applied successfully in commercial scale trials, 18% being the upper limit for the pilot scale equipment used in the early development stages.

PILOT PLANT RESULTS

Figure 1:
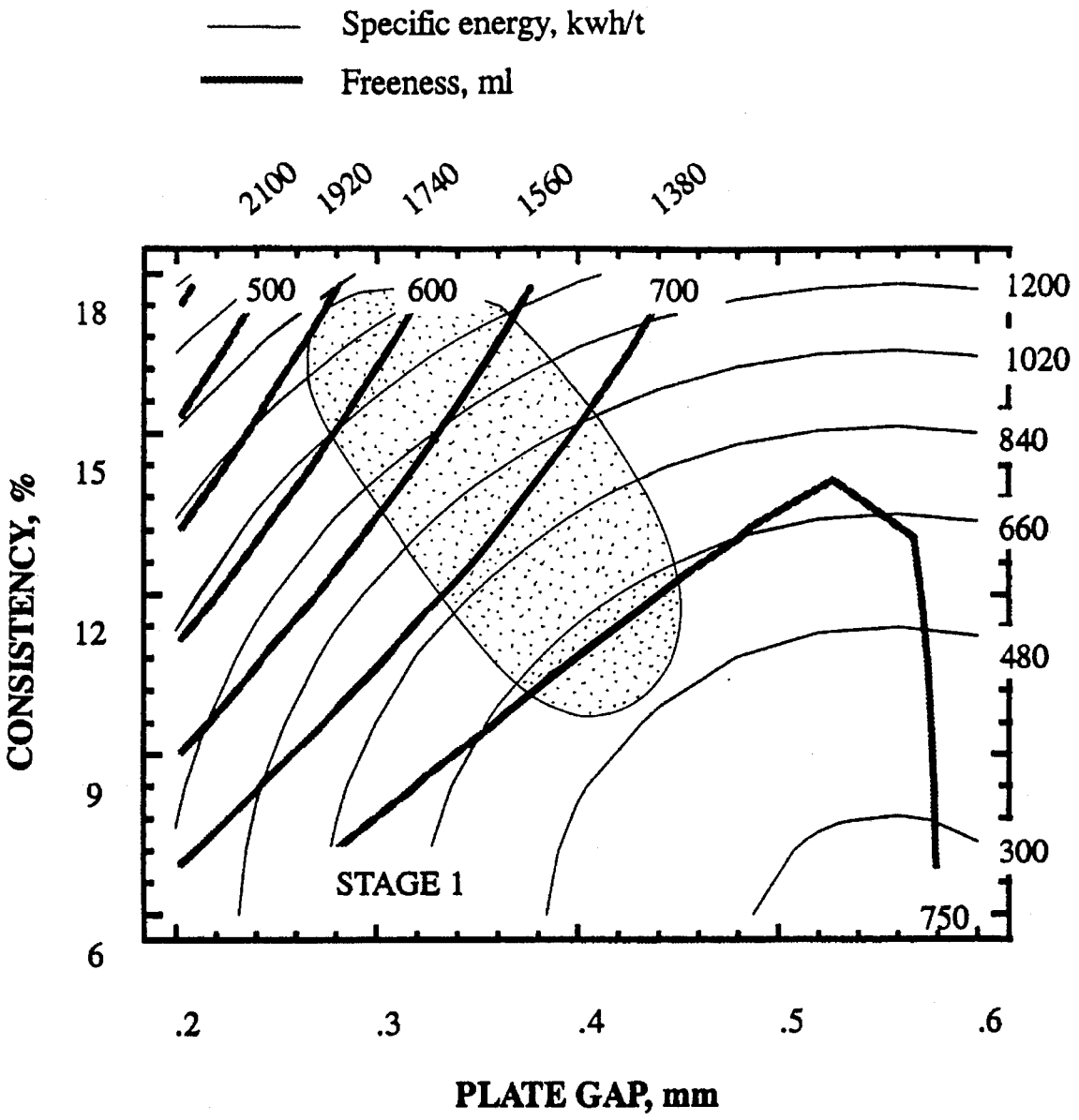

The effect of plate gap and consistency on freeness and specific energy in the first stage is shown in FIG. 1. The results in this diagram show that there are several ways to reach a specified freeness level, some of them being more efficient than others. For example, to obtain a freeness value of 700 ml, one can apply 1200 kWh/t by using a plate gap of approximately 0.43 mm combined with a consistency of 17%. However the same freeness can be obtained using a plate gap of 0.33 mm at 12% consistency, this time consuming only 900 kWh/t, which represents 25% less energy. Certain combinations of plate gap and consistency are therefore more energy efficient than others, but the impact on handsheet quality must also be considered.

Figure 2A:
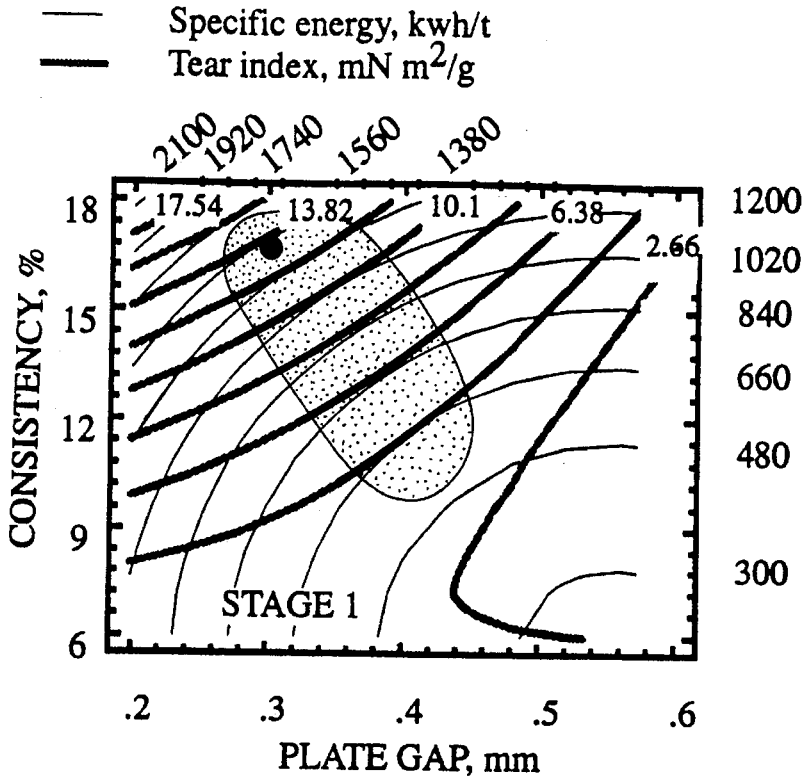
Figure 2B:
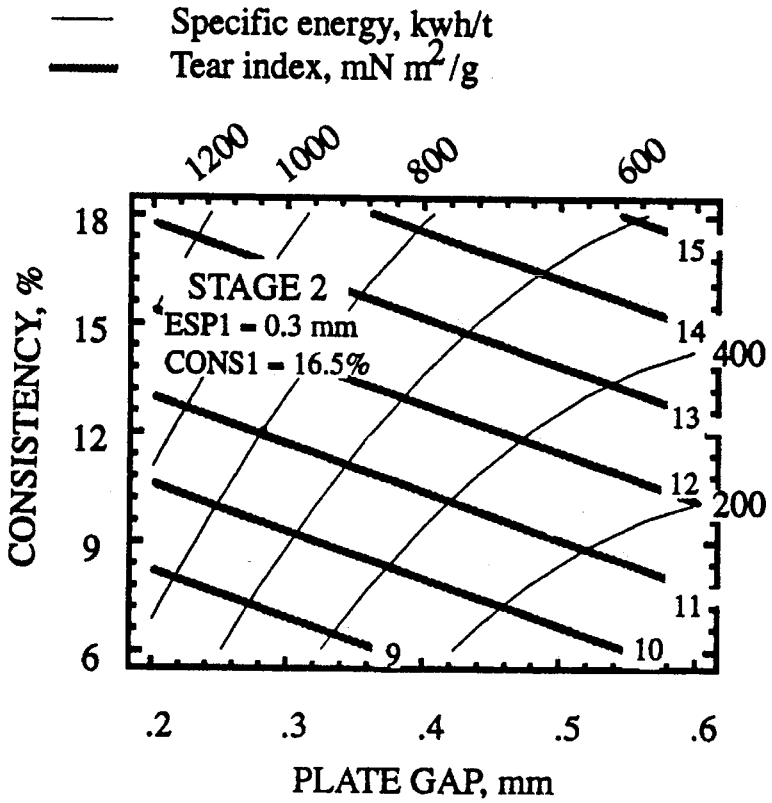
Figure 3:
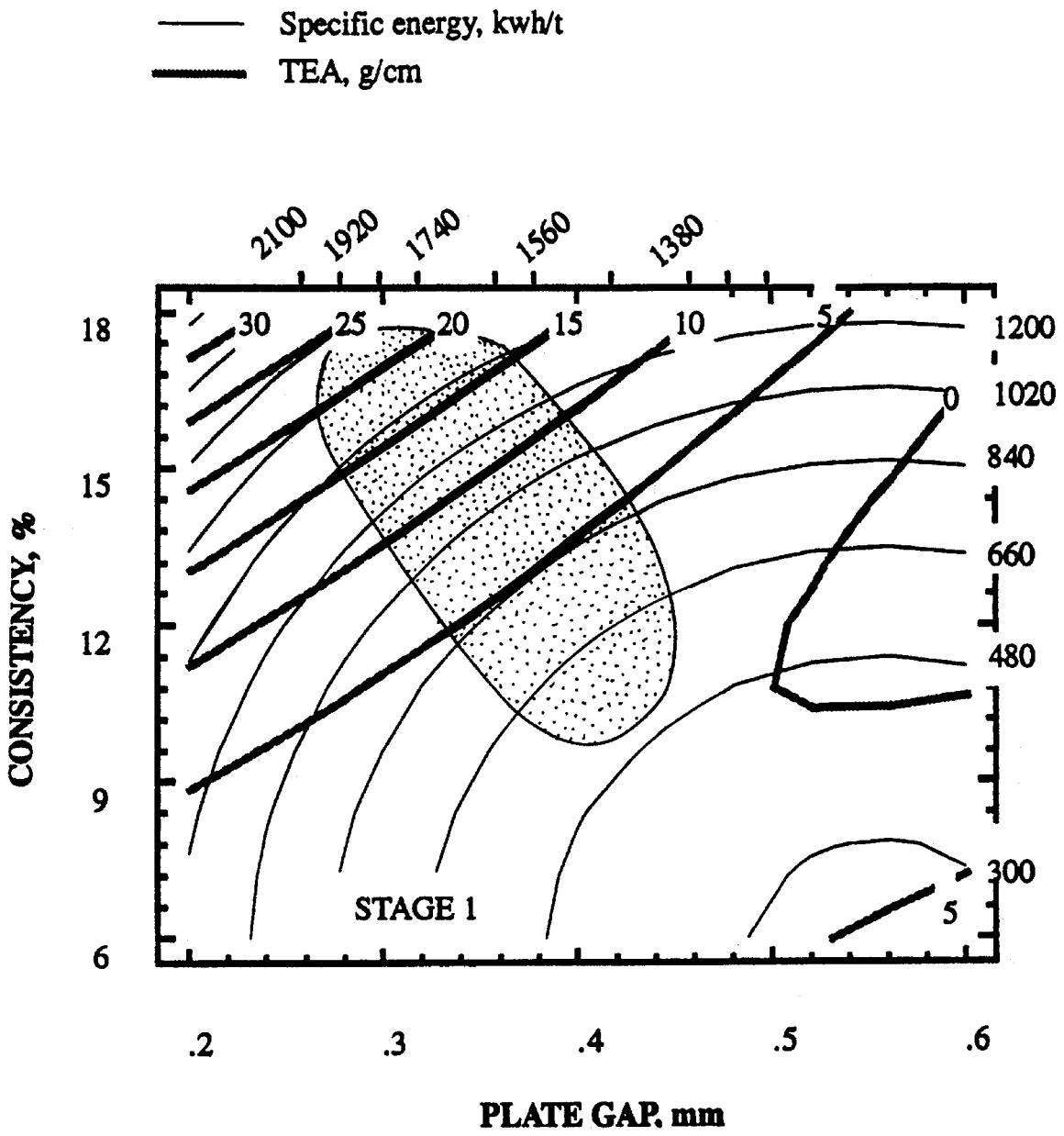
FIG. 3 illustrates how pulp handsheet tensile strength (expressed as tensile energy absorbed or TEA) and refiner energy consumption are affected by changes in the plate gap and consistency used in the primary stage of pilot-scale refining.
Figure 4:
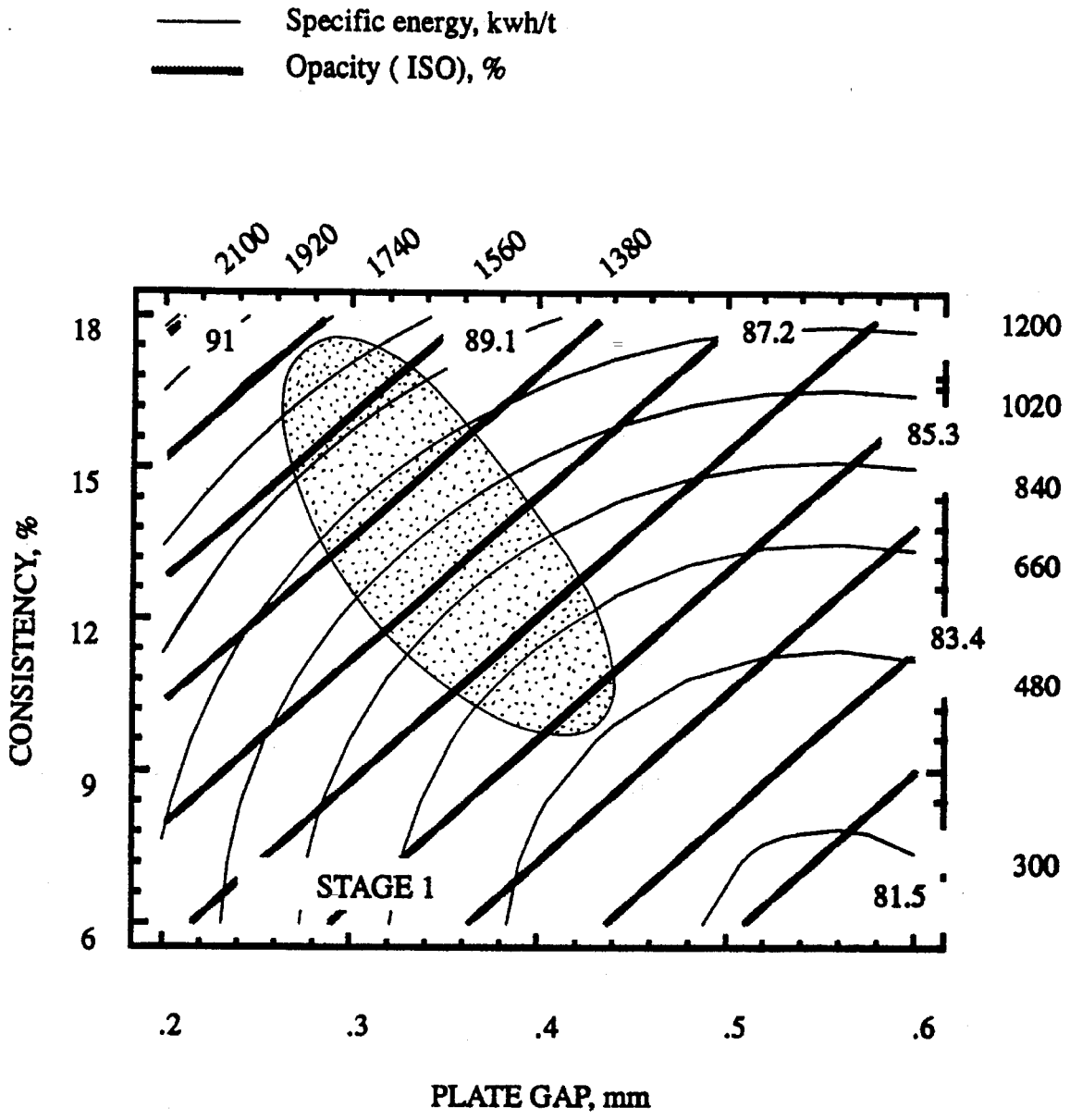
FIG. 4 illustrates how pulp handsheet opacity and refiner energy consumption are affected by changes in the plate gap and consistency used in the primary stage of pilot-scale refining.

The response of tear index, tensile energy (TEA) and opacity to changes in plate gap and consistency in the first stage of refining is illustrated in FIGS. 2–4. Combinations of plate gap and consistency which provide the highest quality for the lowest energy input are contained in the oval shaped zone highlighted in each figure. Using these diagrams, it can be observed that by applying 1200 kWh/t with a plate gap of 0.5 mm and a consistency of 17.5%, we obtain a pulp with a tear index of roughly 7 $mNm^2/g$, a tensile energy of 7 g/cm and an opacity of 87% (ISO). By moving into the highlighted zone and applying the same energy at 15% consistency with a plate gap of 0.32 mm, we now obtain a pulp with tear index of 10 $mNm^2/g$, a tensile energy of 12.5 g/cm and an opacity of 88.5%. Refining conditions within this optimal operating zone can therefore be used to reduce energy consumption for a given quality target or improve pulp quality at the current energy level This type of optimal operating zone is not apparent in the secondary refining stage. The results shown in FIG. 2(*b*) for tear index are typical of those obtained for other handsheet properties and indicate that pulp quality exhibits a linear dependency on operating conditions in the second stage of refining. As a result, optimization of two-stage refining should focus on the first stage of refining which, because of its nonlinear behaviour, has the potential of yielding some significant gains in process efficiency.

Figure 5:
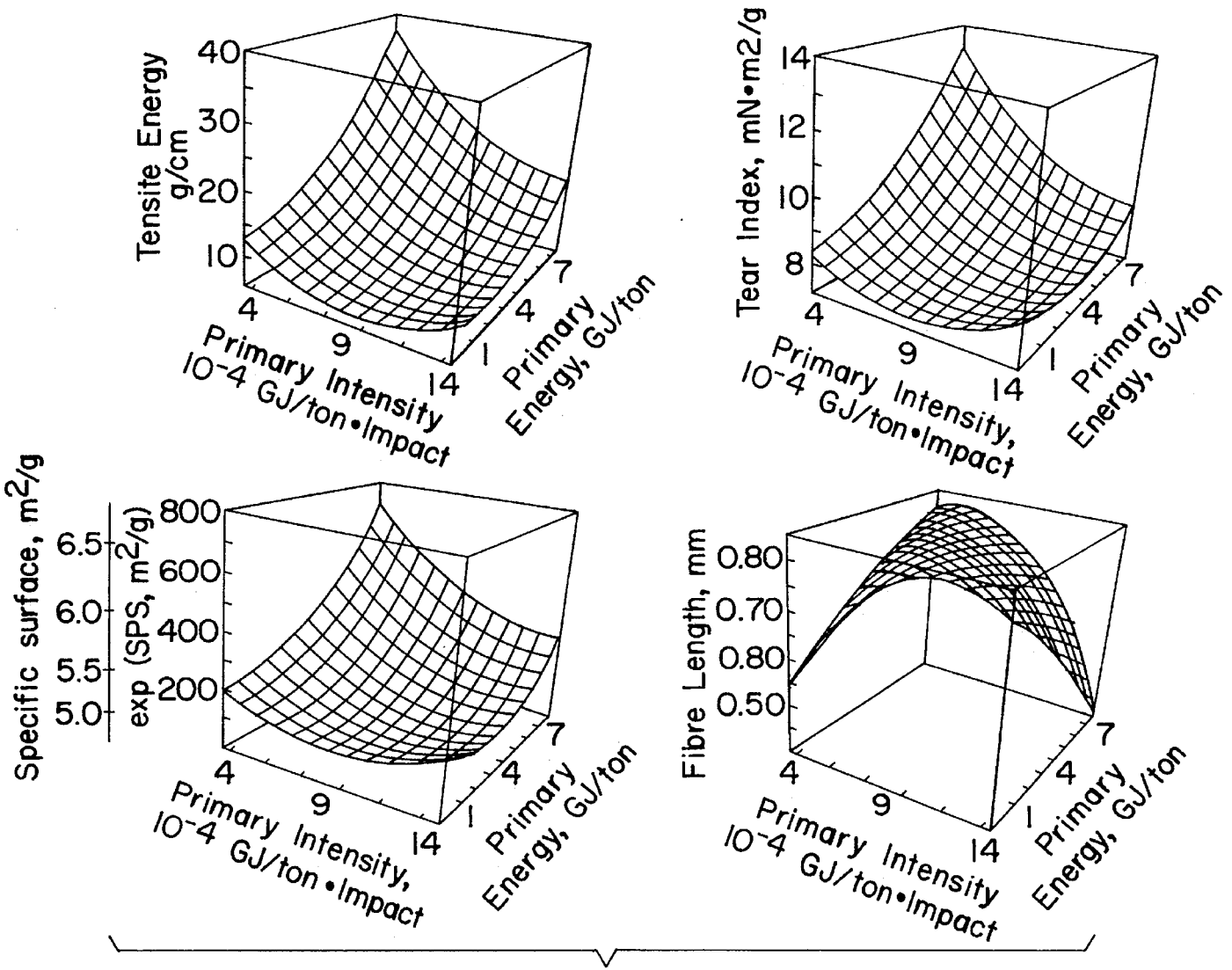
FIG. 5 illustrates the response of whole pulp specific surface and average fibre length to changes in specific energy and refining intensity in the first stage and their effect on final handsheet tear and tensile strength (with secondary refining conducted at 2.3 GJ/t and $10.5\times10^{-4}$ GJ/t·impact)

FIG. 5 summarizes the impact of primary refining on both handsheet and fibre properties in terms of specific energy and refining intensity. As might well be expected, pulp quality is much less sensitive to changes in intensity at low specific energy levels. Both tensile energy and tear index are best developed by applying higher levels of specific energy at low intensity. At the fibre level, these conditions lead to large gains in whole pulp specific surface. The response surface plot of average fibre length in FIG. 5 contains a ridge along which fibre length is constant. This indicates that there exists a proportion of specific energy to refining intensity for which specific surface can be increased significantly without sacrificing average fibre length.

Figure 6:
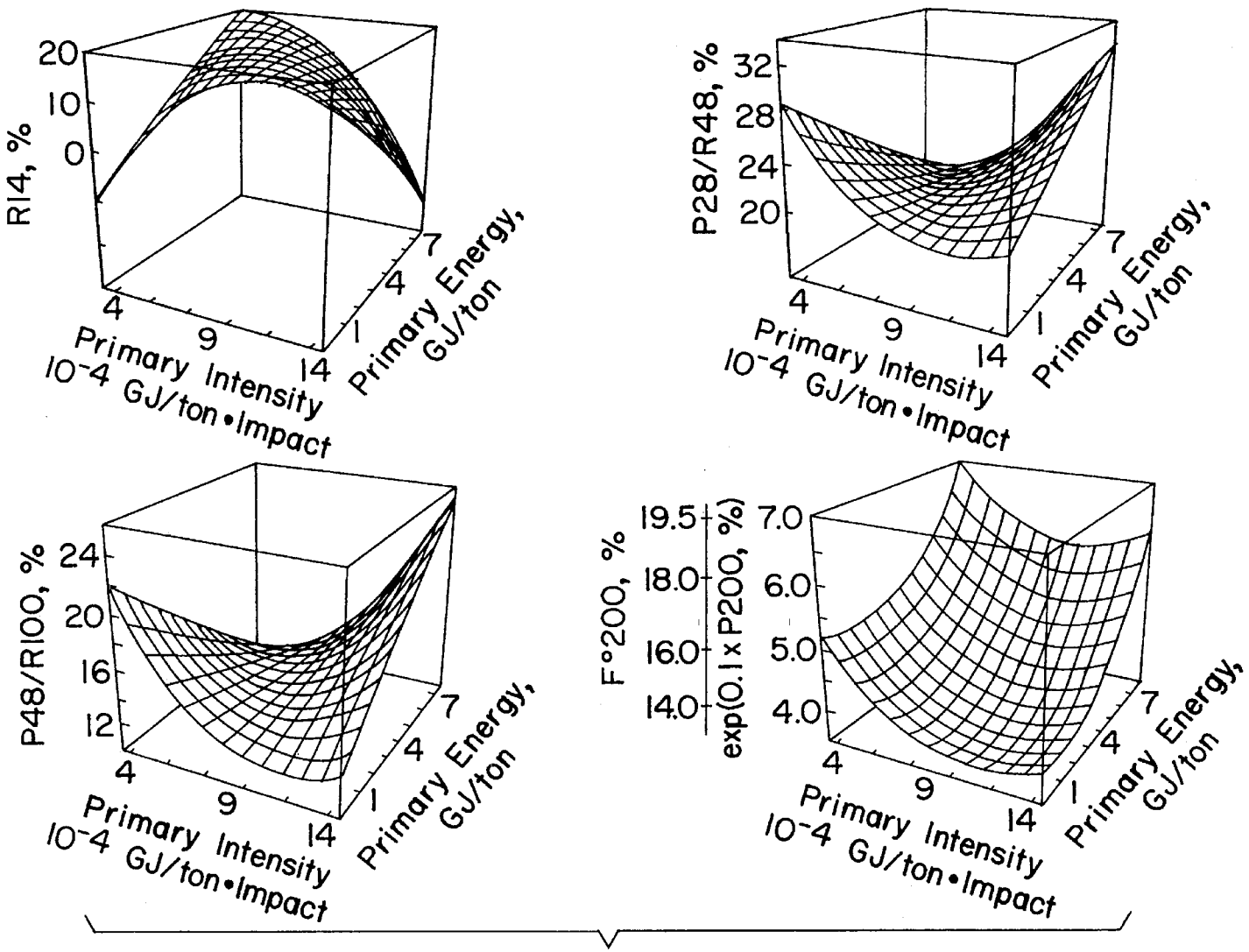
FIG. 6 illustrates the response of various Bauer-McNett fibre length fractions in the final pulp to changes in primary specific energy and refining intensity (with secondary refining conducted at 2.3 GJ/t and $10.5\times10^{-4}$ GJ/t·impact).

The Bauer McNett fractions displayed in FIG. 6 show that while the amount of long fibres is relatively constant along this ridge, material is being removed from the middle fractions to generate fines. Since the average fibre length was determined optically based on a fibre count, a constant average length would indicate a relatively constant proportion of long and medium length fibres. Fines would then be generated not by breaking fibres but by peeling material from the fibre wall.

Figure 7:
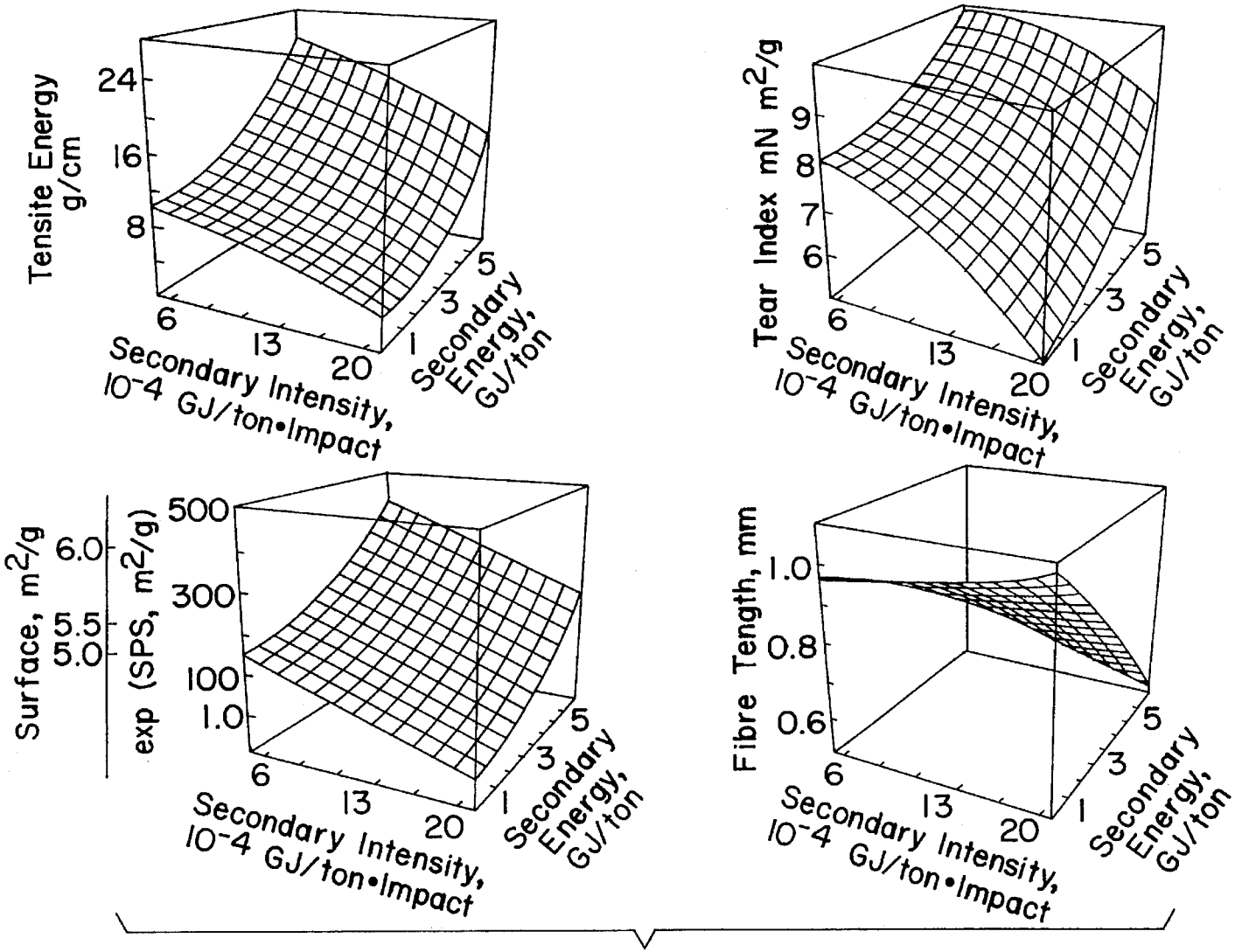
FIG. 7 illustrates the response of whole pulp specific surface and average fibre length to changes in specific energy and refining intensity in the second stage and their effect on final handsheet tear and tensile strength (with primary refining conducted at 2.8 GJ/t and $8.6\times10^{-4}$ GJ/t·impact)

Contrary to the first stage where it was possible to maintain fibre length by operating at a particular ratio of energy to intensity, FIG. 7 indicates that increases in secondary specific energy will invariably reduce average fibre length. Fines and medium length fibres will be generated at the expense of the long fibre fractions as illustrated by the Bauer McNett fractions in FIG. 8. This is very different from the fibre length patterns shown in FIG. 6 which indicate that primary refining can be conducted in such way that fines are generated by removing material from the middle fractions.

The impact of the energy distribution between stages on pulp quality is illustrated in FIG. 9. With the total specific energy constrained to 1800 kWh/t, which is typical for chemi-mechanical pulps, the energy split was adjusted to specific values and optimal consistencies calculated along with predicted pulp quality. A set of parabolic curves was obtained describing changes in tear index, tensile energy and opacity with energy distribution. These curves indicate that the worst handsheet quality is obtained in an operating region where 50 to 65% of the total specific energy is applied in the primary stage. Pulp quality is improved by adjusting the distribution of energy to one side or the other of this operating zone thereby defining two distinct strategies. The first operating regime suggested resembles that proposed in *Tappi Journal*, 1991, 74(3), 221–230 where total energy is distributed between the primary and secondary stages according to a 40:60 split. While applying less energy during primary refining will indeed enhance handsheet quality, the curves in FIG. 9 indicate that quality will be improved at a faster rate by applying at least 65% of the total energy in the first stage. Other problems also arise with the first strategy which uses a low consistency in the first stage of refining and a high consistency in the second stage. This implies that the pulp must be thickened between stages, requiring additional equipment. In the present method, such thickening is not required because the primary refining is operated at high consistency and the secondary refining is operated at low consistency.

By developing and using empirical models to simulate and optimize the refining method, the following behaviour has been observed:

- a distinct operating zone exists where the combinations of plate gap and consistency offer improvements in pulp quality and refiner energy efficiency. This optimal operating zone is observed only for the primary stage of refining which, because of its nonlinear behaviour, has the potential for yielding significant gains in process efficiency;
- energy distributions where 50% to 65% of the total specific energy is applied to the primary refiner or primary stage, should be avoided since these distributions result in lower handsheet tensile energy (TEA), tear index and opacity. A significant improvement in pulp quality can be obtained by applying over 70% of the total energy in the first stage of refining. This strategy has been shown to reduce the energy needed to reach a given quality target by at least 15% over that required when the total refining energy is equally distributed between stages;
- developing specific surface with minimal fibre cutting is possible in the first stage by applying a set proportion of specific energy to refining intensity. When energy and intensity achieve this balance, fine material is peeled primarily from the middle fibre fractions without reducing the amount of long fibre;
- results show that high consistency should be used in the refining stage where the bulk of the specific energy is applied to the pulp. A lower consistency may then be used in the other refining stage to further minimize the overall energy requirements.

Results describing the effect of the initial chemical pretreatment of the chips on the refining treatment indicate that the optimal energy refining strategy presented herein is applicable mainly for yields of pulp on wood above 80%. At lower yields the importance of energy distribution between stages appears to diminish in importance.

COMMERCIAL SCALE TESTS

In order to verify that these effects are still present at the commercial scale, a series of plant trials were conducted. The conditions used during each trial are listed in Table 1. Three ratios of primary to secondary energy were tested, 50:50, 40:60 and 70:30. In the case of the 40:60 and 70:30 ratios, the consistency was lowered in the stage where the least energy was applied. The tests were performed using two independent refining stages, with two single-disc refiners operating in parallel at each stage.

TABLE 1

Summary of refining conditions during commercial trials

| Test No. | | 1 | 2 | 3 | 4 | 5 |
|---|---|---|---|---|---|---|
| Primary Refining | | | | | | |
| Motor load (kW) | Refiner 294 | 2416 | 1601 | 2067 | 2707 | 3124 |
| | Refiner 297 | 2690 | 1711 | 1956 | 2870 | 2918 |
| | Tot. Prim. | 5106 | 3312 | 4023 | 5577 | 6042 |
| Dilution flow (l/min) | Refiner 294 | 6 | 71 | 71 | 6 | 6 |
| | Refiner 297 | 0 | 48 | 48 | 0 | 0 |
| Approximate consistency (%) | Refiner 294 | 30 | 26 | 26 | 30 | 30 |
| | Refiner 297 | 30 | 27 | 27 | 30 | 30 |
| Secondary Refining | | | | | | |
| Motor load (kW) | Refiner 326 | 2214 | 2981 | 2832 | 1275 | 1253 |
| | Refiner 329 | 2798 | 2773 | 2943 | 1141 | 1212 |
| | Tot. Sec. | 5012 | 5754 | 5775 | 2416 | 2465 |
| Dilution flow (l/min) | Refiner 326 | 0 | 0 | 0 | 71 | 71 |
| | Refiner 329 | 0 | 0 | 0 | 74 | 74 |
| Approximate consistency (%) | Refiner 326 | 30 | 30 | 30 | 26 | 26 |
| | Refiner 329 | 30 | 30 | 30 | 26 | 26 |
| Total motor load (kW) | | 10118 | 9066 | 9798 | 7993 | 8507 |
| kW Prim/kW Total | | 0.50 | 0.37 | 0.41 | 0.70 | 0.71 |
| Feed screw speed (rpm) | Refiner. 294 | 19 | 16 | 16 | 19 | 19 |
| | Refiner 297 | 19 | 16 | 16 | 19 | 19 |
| | Refiner 326 | 29 | 29 | 29 | 29 | 29 |
| | Refiner 329 | 29 | 29 | 29 | 29 | 29 |
| CSF Innomatic tester | AI 626 | 643 | | | 674 | 677 |
| | AI 6825 | 493 | 503 | 460 | 568 | 570 |
| CSF Laboratory test | | 463 | 469 | 473 | 574 | 551 |

The results of these mill trials indicate that applying about 70% of the total energy at high consistency (test No. 4 & 5), in the primary stage and the remaining 30% at lower consistency in the secondary stage reduces energy consumption by approximately 18% when compared to an equal energy distribution (test no. 1) conventionally used. Furthermore, the results in Table 2 below, wherein two samples A and B are provided, show that pulp quality was maintained (even slightly improved) at a significantly higher freeness (approx. 100 ml higher). It is expected that lower consistency in the second stage will further improve the process performance.

In contrast, the 40:60 energy split recommended by PAPRICAN (tests No. 2 & 3) was only slightly more efficient than the 50:50 energy distribution and did not significantly differ from the overall average energy consumption for the 5 trials. Further, the quality obtained with the 40:60 energy distribution was inferior to that obtained with a 70:30 distribution.

TABLE 2

Summary of pulp properties obtained in commercial trials

| Primary: | | Test No. | | | | |
|---|---|---|---|---|---|---|
| Secondary kW Split | | 1 50:50 | 2 37:63 | 3 41:59 | 4 70:30 | 5 71:29 |
| Freeness (ml) | A | 463 | 469 | 473 | 574 | 551 |
| | B | 465 | 430 | 440 | 527 | 534 |
| | Avg. | 464 | 450 | 457 | 551 | 543 |
| Shives (%) | A | 0.12 | 0.1 | 0.1 | 0.1 | 0.1 |
| | B | — | — | — | — | — |

TABLE 2-continued

Summary of pulp properties obtained in commercial trials

| Primary: | | Test No. | | | | |
|---|---|---|---|---|---|---|
| Secondary kW Split | | 1 50:50 | 2 37:63 | 3 41:59 | 4 70:30 | 5 71:29 |
| | Avg. | | | | | |
| Tear Index ($mN \cdot m^2/g$) | A | 14.33 | 12.96 | 10.69 | 15.26 | 13.67 |
| | B | 11.23 | 11.08 | 10.53 | 11.17 | 12.00 |
| | Avg. | 12.78 | 12.02 | 10.61 | 13.22 | 12.84 |
| Burts Index ($kPa \cdot m^2/g$) | A | 2.14 | 2.07 | 2.23 | 1.95 | 2.24 |
| | B | 3.10 | 2.78 | 3.06 | 2.95 | 2.73 |
| | Avg. | 2.62 | 2.43 | 2.65 | 2.45 | 2.49 |
| TEA (g/cm) | A | 29.26 | 22.78 | 29.91 | 28.99 | 25.11 |
| | B | 35.13 | 24.79 | 40.57 | 35.24 | 32.93 |
| | Avg. | 32.20 | 23.79 | 35.24 | 32.12 | 29.02 |
| Breaking length (km) | A | 4,53 | 4.08 | 4.37 | 4.62 | 4.48 |
| | B | 4.93 | 4.20 | 5.26 | 5.26 | 5.06 |
| | Avg. | 4.73 | 4.14 | 4.82 | 4.94 | 4.77 |
| Bulk ($cm^3/g$) | A | 2.86 | 2.60 | 2.25 | 3.05 | 2.82 |
| | B | 2.90 | 3.00 | 2.77 | 2.95 | 3.15 |

TABLE 2-continued

| Summary of pulp properties obtained in commercial trials | | | | | | |
|---|---|---|---|---|---|---|
| Primary: | | Test No. | | | | |
| Secondary kW | | 1 | 2 | 3 | 4 | 5 |
| Split | | 50:50 | 37:63 | 41:59 | 70:30 | 71:29 |
| | Avg. | 2.88 | 2.80 | 2.51 | 3.00 | 2.99 |
| Brightness | A | 54.50 | 55.60 | 54.60 | 55.60 | 54.50 |
| (% ISO) | B | 53.50 | 51.70 | 53.00 | 52.10 | 52.70 |
| | Avg. | 54.00 | 53.65 | 53.80 | 53.85 | 53.60 |
| Opacity | A | — | — | — | — | — |
| (% ISO) | B | 90.9 | 90.9 | 90.3 | 90.0 | 89.4 |
| | Avg. | | | | | |

While the invention has been described in connection with specific embodiments thereof, it will be understood that it is capable of further modifications and this application is intended to cover any variations, uses or adaptations of the invention following, in general, the principles of the invention and including such departures from the present disclosure as come within known or customary practice within the art to which the invention pertains, and as may be applied to the essential features hereinbefore set forth, and as follows in the scope of the appended claims.

What is claimed is:

1. In a method for the mechanical treatment of wood fibres, the method comprising the steps of reducing wood chips to individual fibres or fibre bundles by mechanical treatment applied in first and second stages of atmospheric refining using two single-disc refiners or one double-disc refiner, the first refining stage being carried out in a first refiner and the second refining stage being carried out in a second refiner, the improvement which comprises applying at least 65% of the total energy at low intensity in the first stage of refining in the first refiner and the remainder at high intensity in the second stage in the second refiner, in order to reduce the total energy requirement of the method.

2. A method according to claim 1, wherein the improvement comprises applying 75% of the total energy in the first stage of refining.

3. A method according to claim 1 wherein the consistency in the first stage is from 26 to 40% of solids.

4. A method according to claim 3 wherein the consistency in the second stage is from 15 to 26% of solids.

5. In a method for the mechanical treatment of wood fibres, the method comprising the steps of reducing wood chips to individual fibres or fibre bundles by mechanical treatment applied in first and second stages of atmospheric refining using two single-disc refiners, the first refining stage being carried out in a first refiner and the second refining stage being carried out in a second refiner, the improvement which comprises applying between 65% and 85% of the total energy at low intensity in the first stage of refining in the first refiner and the remainder at high intensity in the second stage in the second refiner in order to reduce the total energy requirement of the method.

6. A method according to claim 5 wherein the consistency in the first stage is from 26 to 40% of solids.

7. A method according to claim 6 wherein the consistency in the second stage is from 15 to 26% of solids.

8. In a method for the mechanical treatment of wood fibres, the method comprising the steps of reducing wood chips to individual fibres or fibre bundles by mechanical treatment applied in first and second stages of pressurized refining using two single-disc refiners or one double-disc refiner, the first refining stage being carried out in a first refiner and the second refining stage being carried out in a second refiner, the improvement which comprises applying at least 65% of the total energy at low intensity in the first stage of refining in the first refiner and the remainder at high intensity in the second stage in the second refiner, in order to reduce the total energy requirement of the method.

9. A method according to claim 8, wherein the improvement comprises applying 75% of the total energy in the first stage of refining.

10. A method according to claim 8, wherein the consistency in the first stage is from 26 to 40% of solids.

11. A method according to claim 10, wherein the consistency in the second stage is from 15 to 26% of solids.

* * * * *